US009174452B2

(12) United States Patent
Hatao

(10) Patent No.: US 9,174,452 B2
(45) Date of Patent: Nov. 3, 2015

(54) FLUID DROPLET EJECTION DEVICE AND EJECTION INSPECTION METHOD

(75) Inventor: Yosuke Hatao, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 353 days.

(21) Appl. No.: 13/426,571

(22) Filed: Mar. 21, 2012

(65) Prior Publication Data

US 2012/0242731 A1 Sep. 27, 2012

(30) Foreign Application Priority Data

Mar. 24, 2011 (JP) ..... 2011-065335

(51) Int. Cl.
*B41J 2/165* (2006.01)
*B41J 2/21* (2006.01)

(52) U.S. Cl.
CPC ..... *B41J 2/16579* (2013.01); *B41J 2/2142* (2013.01)

(58) Field of Classification Search
CPC ..... B41J 2/16579
USPC ..... 347/19
See application file for complete search history.

(56) References Cited

U.S. PATENT DOCUMENTS 4,292,640 A * 9/1981 Lammers et al. ..... 347/21
6,478,400 B1 * 11/2002 Endo ..... 347/19
6,744,530 B1 * 6/2004 Someno et al. ..... 358/1.18
2009/0066741 A1 * 3/2009 Komatsu et al. ..... 347/11
2009/0066743 A1 3/2009 Komatsu et al.
2009/0231368 A1 9/2009 Nakano et al.
2013/0027452 A1 1/2013 Nakano et al.
2013/0029047 A1 1/2013 Nakano et al.

FOREIGN PATENT DOCUMENTS

CN 101247957 A 8/2008
JP 2006-187942 A 7/2006
JP 2007-118560 A 5/2007
JP 2008-195037 A 8/2008
JP 2009-190281 A 8/2009
JP 2009-248547 A 10/2009
JP 2010-036382 A 2/2010
JP 2010-201686 A 9/2010
JP 2010-201854 A 9/2010

* cited by examiner

*Primary Examiner* — Manish S Shah
*Assistant Examiner* — Jeffrey C Morgan
(74) *Attorney, Agent, or Firm* — Kilpatrick Townsend & Stockton LLP

(57) ABSTRACT

A print unit prints by ejecting fluid droplets from a plurality of nozzles while moving in a primary scanning direction relative to a print medium. An ejection inspection unit inspects fluid droplet ejection by a group of target nozzles, which are part of an ejection nozzle subset obtained by dividing the nozzles according to the number of nozzles required to form the smallest printing width in the secondary scanning direction. A control unit controls the print unit and the ejection inspection unit, and selects the group of target nozzles in the ejection nozzle subset and performs the ejection inspection each time a specific amount of printing is completed.

6 Claims, 9 Drawing Sheets

| NOZZLE LINE | COLOR OF EJECTED INK |
|---|---|
| A | C |
| B | M |
| C | Y |
| D | Y |
| E | M |
| F | C |

FLUID DROPLET EJECTION DEVICE AND EJECTION INSPECTION METHOD

This application claims priority to Japanese Patent Application No. 2011-065335, filed Mar. 24, 2011, the entirety of which is incorporated by reference herein.

BACKGROUND

1. Technical Field

The present invention relates to a fluid droplet ejection device capable of inspecting fluid ejection from a plurality of ejection nozzles, and to an ejection inspection method.

2. Related Art

Japanese Unexamined Patent Appl. Pub. JP-A-2008-195037 teaches a printing device that performs a fluid droplet ejection process to check if fluid droplets are ejected normally from the ejection nozzles before printing starts. During this ejection inspection the printer taught in JP-A-2008-195037 inspects ejection from each ejection nozzle in the nozzle surface of the printhead, and if an ejection problem is detected in some of the ejection nozzles, substitutes other ejection nozzles that are operating normally to eject the liquid that should be ejected from the ejection nozzles that are not operating normally. The printer then prints and performs a cleaning process after printing ends to suction ink from the ejection nozzles or wipe the nozzle surface, for example. As a result, the end of printing is not delayed even if an ejection problem is detected before printing starts because printing can proceed with good results even without first performing a time-consuming cleaning process.

A problem with this printer, however, is that the ejection inspection process takes a long time because fluid ejection is inspected for every nozzle of the printhead. The inspection time could conceivably be shortened by only inspecting a subset of the ejection nozzles in any one inspection operation. However, if there is an ejection problem in any of the nozzles that are not in the group of inspected nozzles, printing will proceed with some nozzles not ejecting properly, resulting in print defects.

SUMMARY

A fluid droplet ejection device and ejection inspection method according to the present invention enable shortening the time required for one ejection inspection while also minimizing print defects.

One aspect of the invention is a fluid droplet ejection device including a print unit that prints by ejecting fluid droplets from a plurality of ejection nozzles while moving in a primary scanning direction relative to a print medium; an ejection inspection unit that performs an ejection inspection that inspects fluid droplet ejection by a group of target nozzles, which are part of an ejection nozzle subset obtained by dividing the plurality of ejection nozzles according to the number of nozzles required to form the smallest printing width in the secondary scanning direction; and a control unit that controls the print unit and the ejection inspection unit, and changes the group of target nozzles in the ejection nozzle subset and performs the ejection inspection each time a specific amount of printing is completed.

Another aspect of the invention is an ejection inspection method that, using a print unit that prints by ejecting fluid droplets from a plurality of ejection nozzles while moving in a primary scanning direction relative to a print medium, and an ejection inspection unit that performs an ejection inspection that inspects fluid droplet ejection by a selected group of target nozzles, which are part of an ejection nozzle subset obtained by dividing the plurality of ejection nozzles according to the number of nozzles required to form the smallest printing width in the secondary scanning direction, changes the group of target nozzles in the ejection nozzle subset and performs the ejection inspection each time a specific amount of printing is completed.

These aspects of the invention can shorten the time required for an ejection inspection because ejection is inspected for an ejection nozzle subset of all ejection nozzles in the print unit during a single ejection inspection. In addition, because ejection is inspected for ejection nozzles in a group of nozzles forming at least the smallest printing width in each ejection inspection by changing the nozzles that are included in the nozzle subset that is inspected in each ejection inspection, printing is done at least by inspected ejection nozzles if the nozzles are determined to eject ink and pass inspection, and print defects (dropped dots) can be prevented.

As used herein, the term "smallest printing width" is the smallest line width that the print unit can print.

Further preferably, the plurality of ejection nozzles are arranged in nozzle lines with the ejection nozzles disposed at a uniform interval in the secondary scanning direction, and the nozzle lines are disposed in nozzle line groups of N lines offset 1/N pitch in the secondary scanning direction; the ejection nozzle subset includes two or more ejection nozzles belonging to at least different nozzle lines; and the ejection inspection unit changes the group of target nozzles by nozzle line and performs the ejection inspection.

By changing the ejection nozzles to be inspected by nozzle line, controlling driving the print unit during the ejection inspection can be simplified.

Yet further preferably, the nozzle line groups are determined by fluid droplet type; the reference position of nozzle lines 1 to N arranged according to the amount of offset of the nozzle line groups is the same position in the secondary scanning direction regardless of the fluid droplet type; and the ejection inspection unit selects a nozzle line in the secondary scanning direction of a different line number for each fluid droplet type as the group of target nozzles in one ejection inspection.

When ejection nozzles in different nozzle groups in the primary scanning direction can print as desired (such as a desired color) by ejecting different fluid droplets at the same ejection position at different times by the print unit moving in the primary scanning direction, this aspect of the invention inspects fluid ejection for ejection nozzles that discharge at the same ejection position during every ejection inspection. As a result, printing is done at least by inspected ejection nozzles if the nozzles are determined to eject ink and pass inspection, and dropped dots can be prevented at the ejection position.

In another aspect of the invention, a cleaning unit cleans the print unit when more than a specific number of ejection nozzles fail inspection during a specific number of ejection inspections.

Because cleaning is performed in this aspect of the invention only when there are actually nozzles that are not ejecting, the time used for the maintenance process during the printing process can be shortened.

In another aspect of the invention the print unit reprints the immediately preceding content after cleaning is performed.

This aspect of the invention is particularly convenient for the user because printing repeats automatically when a print defect occurs while printing.

In another aspect of the invention the ejection inspection unit includes an ejection drive unit that causes the print unit to eject charged fluid droplets from the ejection nozzles, an ejection target on which the charged fluid droplets that were ejected land, and a detection unit that detects change in current produced in the ejection target when the charged fluid droplets land, and determines ejection from the ejection nozzles based on change in the current.

Because the quantity of fluid consumed by ejection inspection is minimal, this aspect of the invention can suppress consumption of fluid required for maintenance instead of printing.

Other objects and attainments together with a fuller understanding of the invention will become apparent and appreciated by referring to the following description and claims taken in conjunction with the accompanying drawings.

DETAILED DESCRIPTION OF EXEMPLARY EMBODIMENTS

A preferred embodiment of a fluid droplet ejection device and ejection inspection method according to the present invention is described below with reference to the accompanying figures. A fluid droplet ejection device is, for example, a printing device that prints in color by ejecting different colors of ink (fluid droplets) onto roll paper used as the print medium, and inspects fluid ejection from the fluid droplet ejection head each time a specific amount of printing has been completed. As used herein, the width of the roll paper loaded in the fluid droplet ejection device is referred to as the primary scanning direction, and the length of the roll paper is referred to as the secondary scanning direction.

Figure 1:
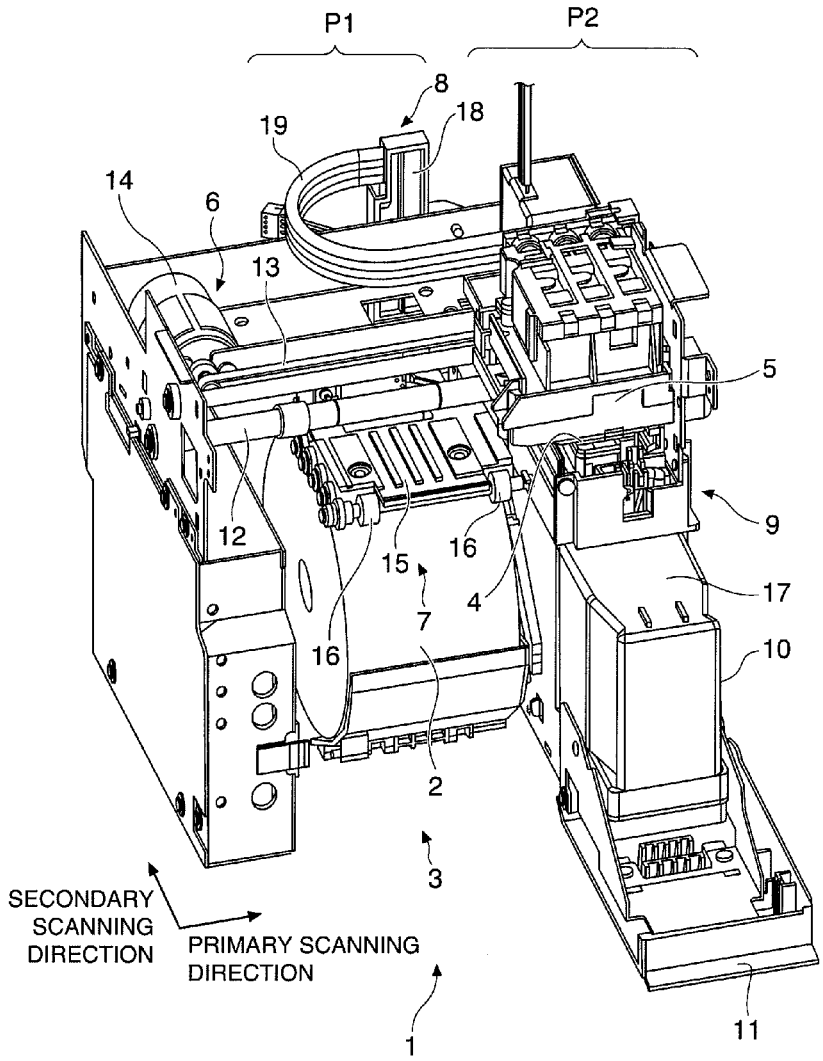
FIG. 1 is an oblique view of a fluid droplet ejection device according to a preferred embodiment of the invention.

As shown in FIG. 1, the fluid droplet ejection device 1 according to this embodiment of the invention includes: a roll paper compartment 3 that holds roll paper 2; a carriage 5 that carries a print unit, or fluid droplet ejection head 4 that ejects plural different inks onto the roll paper 2; a carriage moving mechanism 6 that moves the carriage 5 in the primary scanning direction; a roll paper conveyance mechanism 7 that pulls the end of the roll paper 2 out in the secondary scanning direction; an ink supply mechanism 8 that supplies colored ink to the fluid droplet ejection head 4; a maintenance mechanism 9 that performs maintenance of the fluid droplet ejection head 4; and a control unit (not shown) that controls operation of these other parts. The device 1 is covered by a case (not shown). The fluid droplet ejection device 1 also has a roll paper cover (not shown) for removably loading roll paper 2 into the roll paper compartment 3, and a cartridge cover 11 for removably installing the ink cartridges 10 of the ink supply mechanism 8.

The carriage moving mechanism 6 includes a guide shaft 12 that supports the carriage 5 movably in the primary scanning direction, an endless belt 13 disposed along the guide shaft 12, and a carriage motor 14 that causes the belt 13 to rotate. The carriage moving mechanism 6 drives the carriage motor 14 to turn the belt 13 and move the carriage 5 in the primary scanning direction along the guide shaft 12.

The roll paper conveyance mechanism 7 includes a platen 15 disposed above the roll paper 2 opposite the carriage 5, and a paper feed roller 16 that conveys the end of the roll paper 2 passing thereabove in the secondary scanning direction. The platen 15 pushes the roll paper 2 against the fluid droplet ejection head 4 mounted on the carriage 5, and the paper feed roller 16 conveys and discharges the printed roll paper 2 while pressing the roll paper 2 to the carriage side.

The ink supply mechanism 8 includes an ink cartridge 10 loaded in the ink cartridge loading unit 17, and an ink channel 18 and ink supply tube 19 for supplying color ink to the fluid droplet ejection head 4 from ink packs for each color of ink stored in the ink cartridge 10. The embodiment illustrated in FIG. 1 uses ink packs and ink supply tubes 19 for three colors of ink: cyan (C), magenta (M), and yellow (Y).

The maintenance mechanism 9 has a head cap 21 (FIG. 5) for sealing the nozzle surface 20 of the fluid droplet ejection head 4, an ink suction mechanism, and a wiper mechanism (both not shown) disposed opposite the carriage 5 at a position removed in the primary scanning direction from above the roll paper 2. One end of a tube from the ink suction mechanism is connected to the head cap 21, and can reduce the pressure inside the head cap 21 so that ink is suctioned from the ejection nozzles N in the nozzle surface 20 by driving the pump motor of the ink suction mechanism. The wiper mechanism wipes contamination from the nozzle surface 20 using, for example, a rubber wiper.

The maintenance mechanism 9 cleans the fluid droplet ejection head 4 by operating the ink suction mechanism and/or the wiper mechanism. Note that the maintenance mechanism 9 performs the cleaning after fluid ejection from the fluid droplet ejection head 4 is inspected if an ejection problem is found in the ejection inspection. The inspection is described further below.

Note that the position where the carriage 5 is opposite the roll paper 2 is the printing position P1, and the position where the carriage 5 is opposite the maintenance mechanism 9 is the maintenance position P2. The fluid droplet ejection device 1 moves the carriage 5 to the printing position P1 for printing, and moves the carriage 5 to the maintenance position P2 for maintenance of the fluid droplet ejection head 4.

Figure 2:
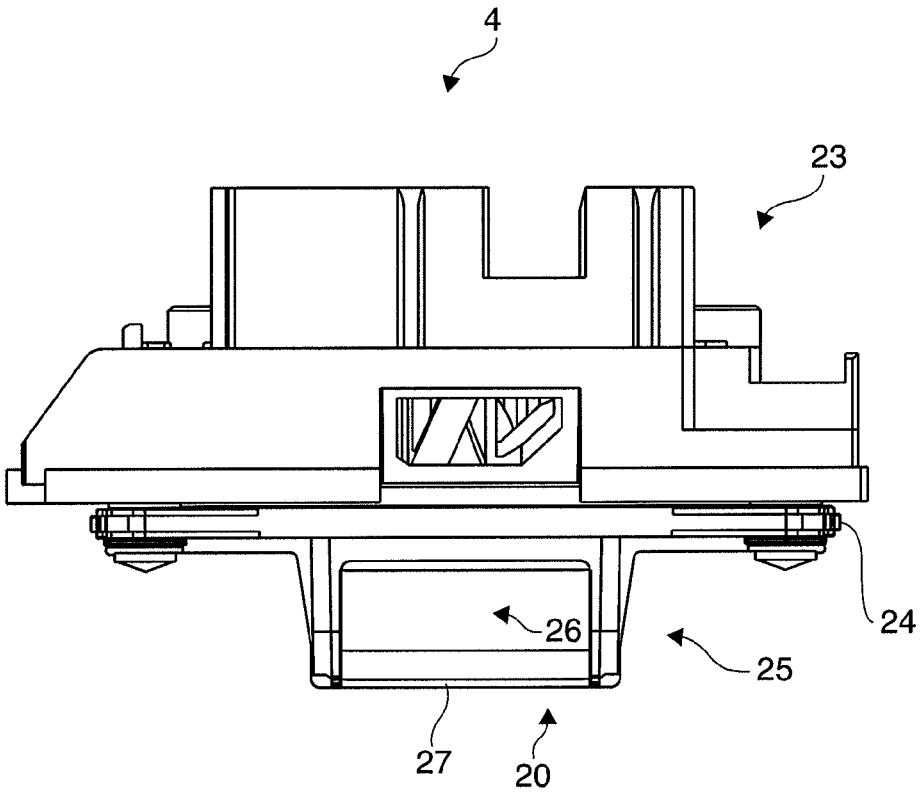
FIG. 2 is an external side view of the fluid droplet ejection head.
Figure 3A:
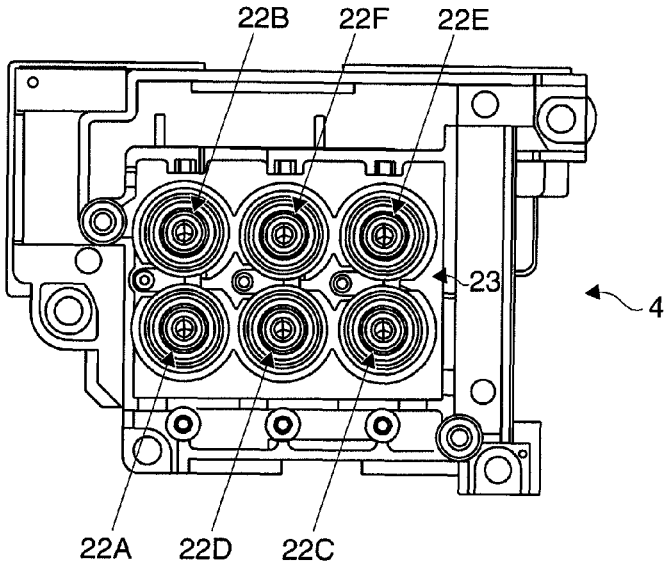
FIG. 3A is a plan view of the fluid droplet ejection head viewed from the ink supply side.
Figure 3B:
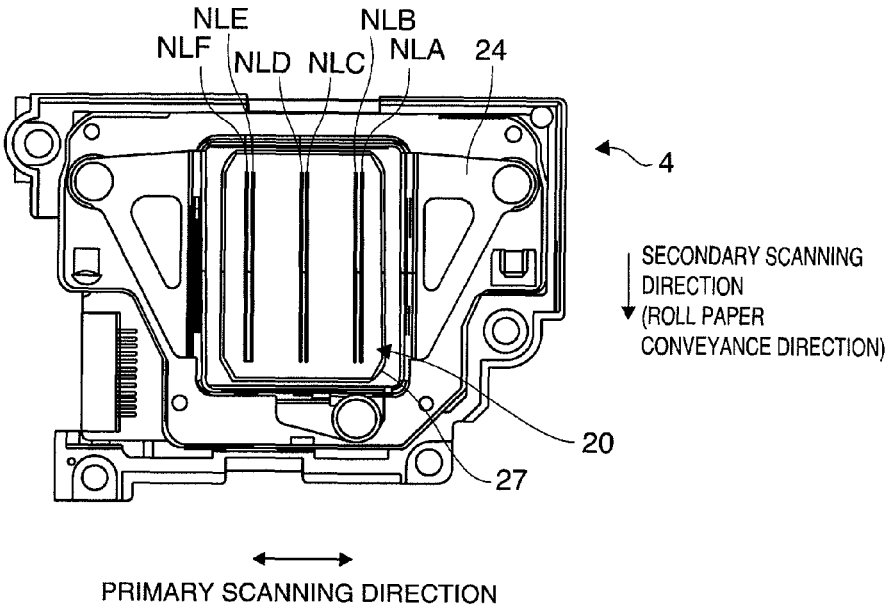
FIG. 3B is a plan view of the fluid droplet ejection head viewed from the nozzle surface side.

As shown in FIGS. 2, 3A, and 3B, the fluid droplet ejection head 4 of the illustrated embodiment is a six-channel inkjet head, and has an ink inlet unit 23 with six connection needles 22; a head substrate 24 connected to the ink inlet unit 23; and a printhead 25 that is connected to the head substrate 24 and ejects ink. The ink inlet unit 23 has six connection needles 22A to 22F corresponding to the six nozzle lines NLA to NLF, and ink is supplied thereto from the ink supply mechanism 8. Note that the correlation between the connection needles 22 and the nozzle lines NL is as shown in FIGS. 3A and 3B.

The printhead 25 also has six pump units 26 rendered by piezoelectric devices, for example, and a nozzle plate 27 with a nozzle surface 20 in which a plurality of ejection nozzles N are provided. The fluid droplet ejection device 1 ejects colored ink from the ejection nozzles N by applying the drive signals output from a control device to each pump unit 26.

Figures 4A, 4B:
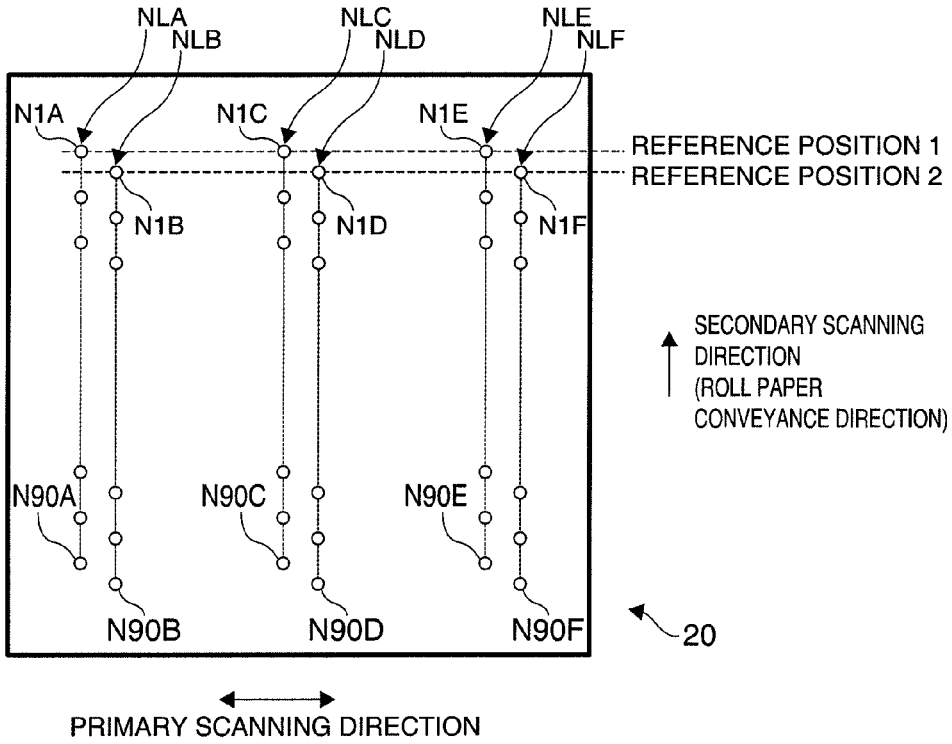
FIG. 4A schematically illustrates the relative locations of the ejection nozzles on the nozzle surface.
FIG. 4B is a table showing the types of ink ejected from each nozzle line.

FIG. 4A schematically illustrates the arrangement of the ejection nozzles N in the nozzle surface 20 of the nozzle plate 27. Note that this figure shows the nozzle plate 27 rotated 180 degrees from FIG. 3. In the embodiment shown in the figure, the numerous ejection nozzles N are arranged in six nozzle lines NLA to NLF. Each nozzle line NL has, for example, 90 ejection nozzles N1 to N90 spaced at a uniform nozzle pitch in the secondary scanning direction. Three of the nozzle lines NLA, NLC, NLE are disposed at reference position 1, and the other three nozzle lines NLB, NLD, NLF are disposed at reference position 2, which is offset ½ nozzle pitch in the secondary scanning direction from reference position 1. The nozzle lines NL are thus substantially parallel to one another (within manufacturing tolerances) and offset approximately half a nozzle pitch (within manufacturing tolerances).

FIG. 4B shows the color of ink ejected from each nozzle line NL. As shown in the figure, nozzle lines NLA and NLF eject cyan (C), nozzle lines NLB and NLE eject magenta (M), and nozzle lines NLC and NLD eject yellow (Y). Note that each color of ink is ejected from one nozzle line NL at each of the two reference positions.

Note that a "nozzle line group" as used in the accompanying claims refers to, for example, the nozzle lines NLA and NLF, nozzle lines NLB and NLE, and nozzle lines NLC and NLD that eject the same color of ink (or, as more generally stated in the claims, the same type of fluid).

The fluid droplet ejection head 4 prints the smallest printing width (smallest line width) in the secondary scanning direction by ejecting ink from a nozzle subgroup composed of the six ejection nozzles N with the same numerical position in each nozzle line NL, e.g. N37A, N37B, N37C, N37D, N37E, and N37F, half of which are at a first position in the secondary scanning direction and half of which are at a second position, offset half a nozzle pitch from the first.

The smallest printing width is the thinnest line that the fluid droplet ejection device 1 can print. For example, as shown in FIG. 4 (*a*), the smallest printing width at the furthest downstream position of the print area is printed by the six ejection nozzles N1A, N1B, N1C, N1D, N1E, N1F. The fluid droplet ejection head 4 is thus configured to print the smallest printing width by means of plural ejection nozzles with a gap of a half nozzle pitch therebetween. The fluid droplet ejection head 4 prints in color by moving in the primary scanning direction while the ejection nozzles N with the same nozzle number in each nozzle line NL eject a different color of ink at the same two positions offset half a nozzle pitch from one another.

Figure 5:
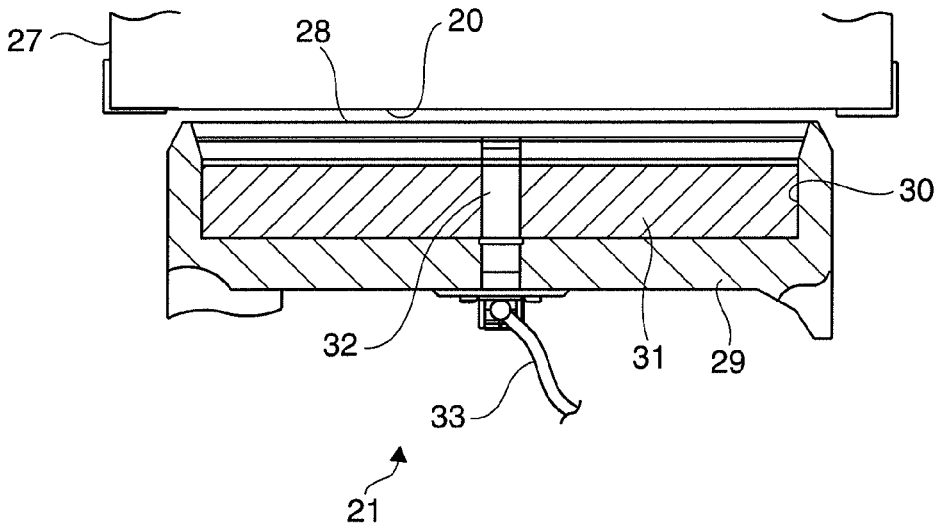
FIG. 5 is a cross-sectional view of the head cap.

FIG. 5 is a section view of the head cap 21 of the maintenance mechanism 9. As shown in the figure, the head cap 21 has a lip 28 made of rubber or other elastic material that can fit tight to the nozzle surface 20; a box-shaped cap body 29 with an opening large enough to seal the nozzle surface 20 of the fluid droplet ejection head 4; a multilayer absorbent sponge 31 that absorbs waste ink contained in the recess 30 of the cap body 29; a metal shaft 32 that is electrically connected with the absorbent sponge 31 and stands inside the recess 30 of the cap body 29; and a lead 33 connected to the bottom end of the metal shaft 32. The absorbent sponge 31 is positioned with a gap between it and the lip 28.

The maintenance mechanism 9 inspects the ink ejection state of ejection nozzles N of the fluid droplet ejection head 4 each time one unit of printing ends. A unit of printing is based on print data units, which are created by dividing all print data into units of a specific size, such as single page, as will be described later on.

This ejection inspection first positions the head cap 21 opposite the nozzle surface 20 of the fluid droplet ejection head 4, and then selectively discharges electrically charged ink from an ejection drive unit, i.e. a plurality of ejection nozzles N. Change in the current produced when the charged ink that is ejected lands on the ejection target, i.e. the absorbent sponge 31 is then detected through the detection unit, i.e. the metal shaft 32 and lead 33.

The ejection inspection is performed once for a plurality of ejection nozzles N, the result of the ejection inspection is "fail" (defective fluid ejection) if the number of ejection nozzles in the group of tested ejection nozzles N determined to have not ejected ink exceeds a specific number, and the result is "pass" (good fluid ejection) if the number of ejection nozzles N determined to have not ejected ink is less than or equal to this specific number.

The term "ejection inspection unit" in the accompanying claims can include, e.g., the control unit and maintenance mechanism 9.

Figure 6A:
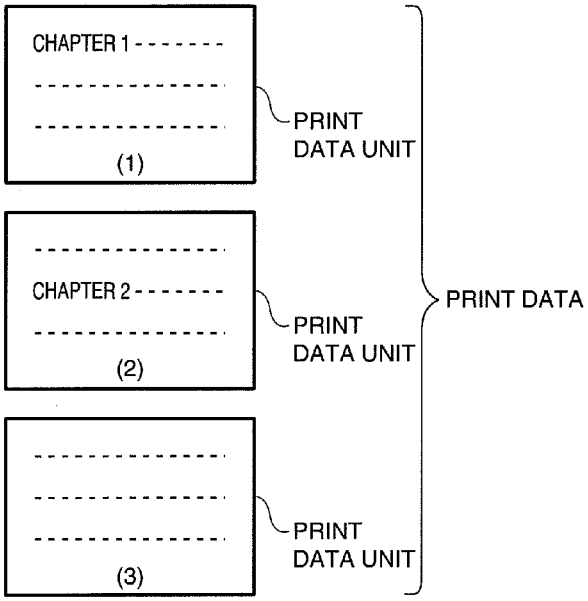
FIG. 6A schematically illustrates print data units.

Dividing the print data into print data units in an exemplary embodiment of the invention is described next with reference to FIGS. 6A and 6B. In the example in FIG. 6A, the print data is divided into the individual pages, formed each time the roll paper is cut, for a single continuous job; each page is one unit of print data. The content of each print data unit is different in this case.

Figure 6B:
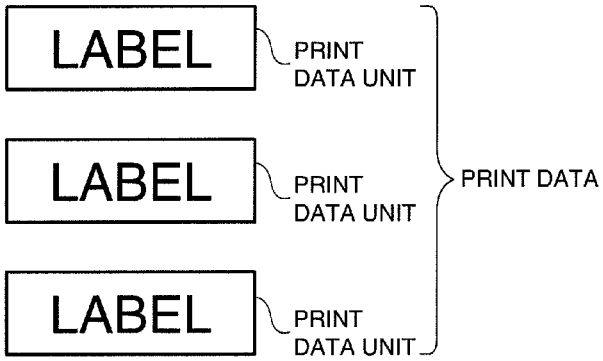
FIG. 6B schematically illustrates an alternative embodiment of print data units.

In the example in FIG. 6B, the total print data consists of print data of the same content being repeated several times; the content of each print data unit is the same in this case.

By performing the ejection inspection each time one unit of printing is completed, the amount of printed roll paper on which print dropout may occur can be minimized.

The ejection nozzles N that are inspected in the ejection inspection described above are described next with reference to FIG. 7.

The control unit of the fluid droplet ejection device 1 inspects a different subset of the nozzle lines NL for each inspection. In other words, the fluid droplet ejection device 1 changes the nozzle lines NL to be inspected in each ejection inspection.

Figure 7A:
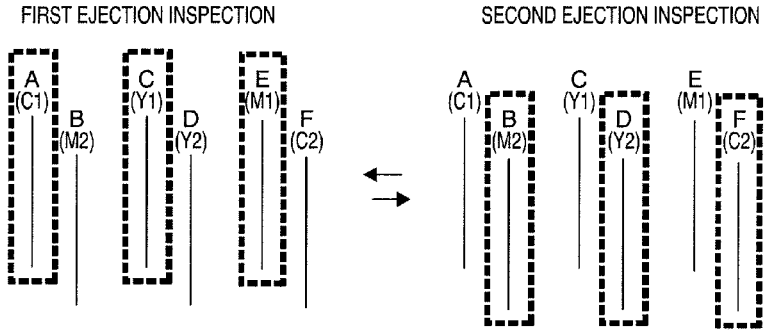
FIGS. 7A-7C each schematically illustrates one exemplary selection pattern for the nozzle line to be inspected.
Figure 7B:
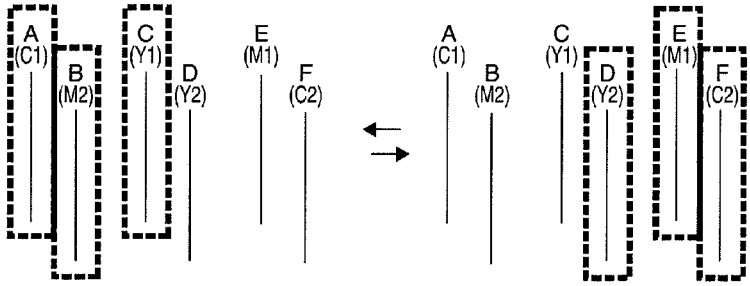
Figure 7C:
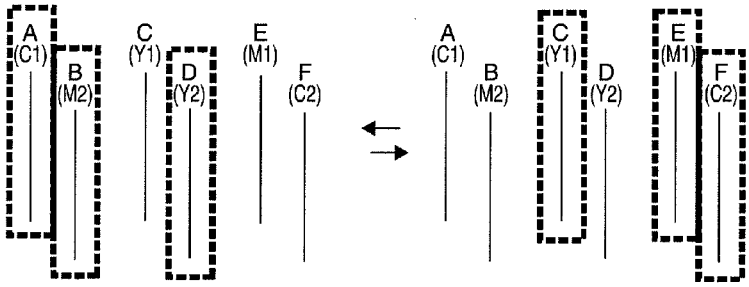

FIGS. 7A-7C show three exemplary patterns in which the ejection nozzles N change in each ejection inspection.

In pattern 1 shown in FIG. 7A, ejection by the three nozzle lines NLA, NLC, NLE referenced to reference position 1 is inspected in the first ejection inspection. In the second ejection inspection, ejection by the three nozzle lines NLB, NLD, NLF referenced to reference position 2 is inspected, as indicated by the bold, dotted lines. Ejection nozzles N that eject each color of ink at the same reference position are thus inspected in each ejection inspection with pattern 1. As a result, at least one ejection nozzle N discharging each color of ink that is part of the same group of ejection nozzles N used to form the smallest printing width can be inspected in every ejection inspection. Therefore, by performing the cleaning process when inspection fails and reprinting the immediately preceding print unit, dropout can be prevented without inspecting all ejection nozzles N in every ejection inspection. In other words, if the first inspection on the left-hand side of FIG. 7A fails, the second inspection on the right-hand side need not be performed.

With pattern 2 in FIG. 7B, the nozzle lines NLA and NLC that are disposed to reference position 1 and eject cyan ink and yellow ink, and the nozzle line NLB disposed to reference position 2 that ejects magenta ink, are inspected in the first ejection inspection. The remaining nozzle lines NLD, NLE, NLF are then inspected in the second ejection inspection.

With pattern 3 in FIG. 7C, the nozzle line NLA that is disposed to reference position 1 and ejects cyan ink, and the nozzle lines NLB and NLD disposed to reference position 2 that eject magenta ink and yellow ink, are inspected in the first ejection inspection. The remaining nozzle lines NLC, NLE, NLF are then inspected in the second ejection inspection. Patterns 2 and 3 thus inspect the nozzle lines NL that eject cyan and magenta and are disposed at different reference positions in the first ejection inspection. As a result, dropout of black dots, which are primarily affected by ejection of cyan and magenta, can be prevented at the ejection positions on one of the reference positions.

The patterns illustrated in FIGS. 7A-7C are shown and described for exemplary purposes. Other patterns are within the scope of the appended claims.

Operation of the fluid droplet ejection device 1 including the ejection inspection is described next with reference to FIGS. 8A-8D. Note that the plural ejection nozzles N inspected in the first ejection inspection are referred to as "inspection target 1" and the plural ejection nozzles N inspected in the second ejection inspection are referred to as "inspection target 2" below. These nozzles can be, e.g., those inspected on the left- and right-hand sides, respectively, of any of FIGS. 7A-7C.

Black dots (●) in FIGS. 8A-8D denote good nozzles that eject normally, and solid arrows indicate that printing (ejection) occurs with the inspection target ejecting normally. Open circles (○) denote defective nozzles that are not ejecting normally, and dotted arrows indicate that printing (ejection) occurs with the inspection target not ejecting normally (defective ink ejection). In addition, the bold, dotted outlines indicate inspection.

Note that if printing proceeds with either inspection target 1 or inspection target 2 ejecting normally while printing, printing results in a good printout. However, if printing occurs with both inspection targets 1 and 2 ejecting defectively, the likelihood of dropped dots occurring while printing is high and the printout will be defective. Therefore, the method of FIGS. 8A-8D corrects the latter case (both inspection targets ejecting defectively) without the need to check every inspection target in every single case, thus providing better speed over the prior art in many cases.

Also note that CN denotes a cleaning process.

Figure 8A:
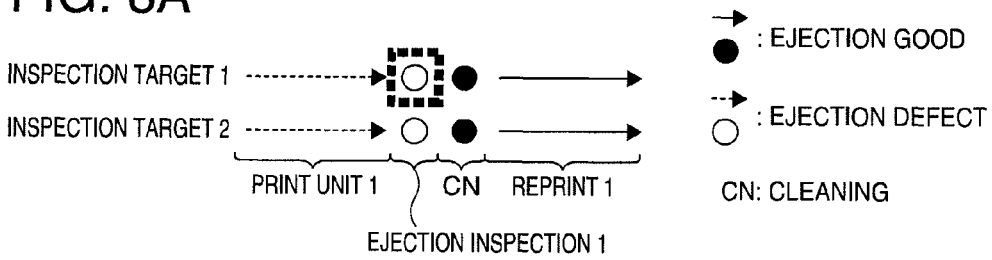
FIGS. 8A-8D schematically illustrate the printing process schedule.
Figure 8B:
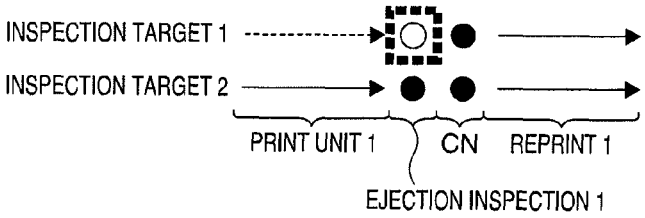

FIGS. 8A and 8B show cases in which inspection failed due to defective ejection in the first ejection inspection. After printing the first print data unit (print unit 1), the fluid droplet ejection device 1 performs the first ejection inspection (ejection inspection 1), and then performs the cleaning process, because of the failed inspection. Print unit 1 is then printed again (reprint 1). Because the likelihood of a print defect in print unit 1 is high if the first ejection inspection fails and inspection target 2, which was not inspected in the first ejection inspection, is not ejecting normally in FIG. 8A, the print data unit can be reprinted effectively by performing the cleaning process and reprint 1. In other words, inspection target 2 is not inspected in the example of FIGS. 8A and 8B.

Figure 8C:
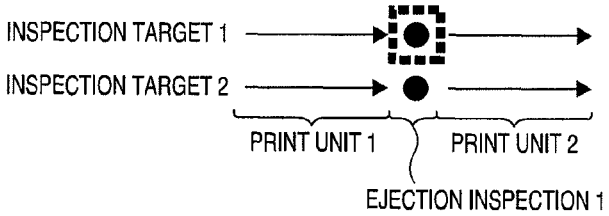
Figure 8D:
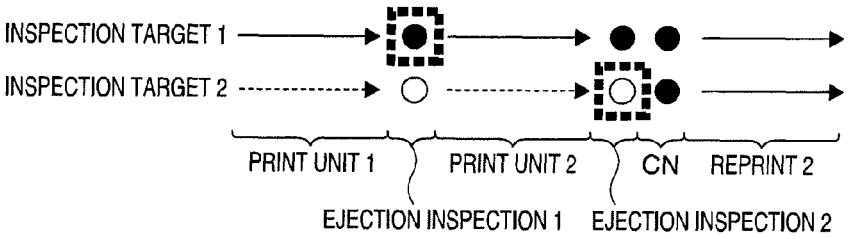

FIGS. 8C and 8D show a case in which the first ejection inspection passed. After print unit 1, the fluid droplet ejection device 1 performs ejection inspection 1, and based on the passed inspection, prints the next print data unit (print unit 2), without cleaning. Even if inspection target 2 (which was not inspected in the first ejection inspection) is not ejecting normally at this time as shown in FIG. 8D, printing is completed with good results by means of the nozzles N in the inspection target 1 that passed inspection. In addition, a result of fail is later obtained for inspection target 2 in ejection inspection 2 performed after printing unit 2, as shown in ejection inspection 2 in FIG. 8D. In addition, by performing the cleaning process and reprinting print data unit 2 (reprint 2) based on the result of this inspection, the possibility of print defects in printing unit 2 can be covered even if inspection target 1 is not ejecting normally at the time of ejection inspection 2.

Figure 9:
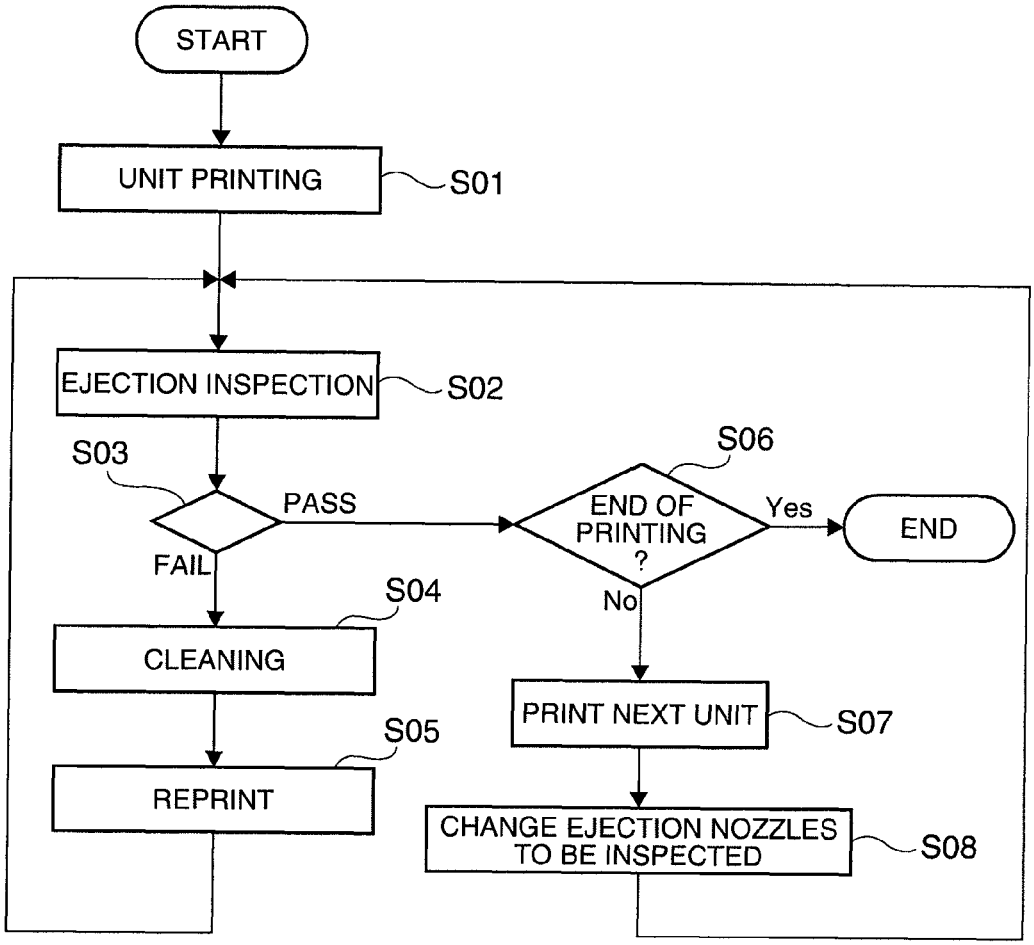
FIG. 9 is a flow chart of the printing process.

The printing process of the fluid droplet ejection device 1 is described next with reference to the flow chart in FIG. 9.

The fluid droplet ejection device 1 first prints the first print data unit (S01), and then performs inspection (S02). If the inspection fails (S03 returns FAIL), the cleaning process is applied to the fluid droplet ejection head 4 (S04), and the second ejection inspection is not performed. The print data unit that was just printed is then reprinted (S05).

However, if the inspection passes (S03 returns PASS) and printing all print data is completed (S06 returns Yes), the process ends, and the second ejection inspection is not performed.

If printing all print data is not completed (S06 returns No), the next print data unit is printed (S07) before the second ejection inspection is performed. The group of nozzles inspected in the last ejection inspection is then changed (S08) and the next group of nozzles is inspected (S02). Steps S02 to S05, or S02 and S06 to S08 repeat thereafter.

Because the ejection inspection method of the fluid droplet ejection device 1 changes the group of nozzles to be inspected within the plurality of ejection nozzles N that form the smallest printing width every time a specific amount of printing is completed, the time required for each ejection inspection can be shortened and dropped dots can be prevented. The time required for the complete printing process can therefore be shortened. In addition, because the cleaning process is applied to the fluid droplet ejection head 4 only when ejection inspection fails, the number of times the cleaning process is performed can be reduced, and the amount of ink consumed without printing can be reduced.

While the heretofore described embodiments perform the cleaning process when any one ejection inspection fails, it is also possible to perform the cleaning process when inspection fails a specific number of times over plural ejection inspections. As a result, performing the cleaning process unnecessarily when print defects have not occurred and delaying the printing process can be prevented. Reprinting unnecessarily can also be reduced.

The number of fluid droplet ejection heads 4 in the fluid droplet ejection device 1, the number of ejection nozzles N, the number of nozzle lines NL, and the number of different inks can also be determined as desired. The print medium is also not limited to roll paper as described above, and the invention can also be used with cut sheet or other media.

Elements of the fluid droplet ejection device 1 described above can also be provided as a program. The program can also be supplied stored on a storage medium. Examples of such storage media include CD-ROM, flash ROM, memory cards (Compact Flash®, smart media, and memory sticks, for example), CDs, magneto-optical media, DVDs, and floppy disks.

The configuration of and steps performed by the fluid droplet ejection device 1 are also not limited to the foregoing embodiment, and the invention can be varied in many ways, which will be apparent to those of ordinary skill in the art, based on the teachings herein. Such variations are not to be regarded as a departure from the spirit and scope of the invention, and all such modifications as would be apparent to those of ordinary skill in the art are intended to be included within the scope of the following claims.

What is claimed is:

1. A fluid droplet ejection device for ejecting fluid droplets of a plurality of fluid types, the device comprising:

a print unit comprising a plurality of nozzle lines, each nozzle line comprising a plurality of nozzles generally aligned in a secondary scanning direction of the print unit, wherein all the nozzles of each nozzle line are configured to eject fluid droplets of a single one of the fluid types, the print unit being configured to eject the fluid droplets from the nozzles while moving in a primary scanning direction relative to a print medium;

an ejection inspection unit configured to inspect fluid droplet ejection of one subset of the nozzles at a time, wherein each subset comprises at least one nozzle for each of the plurality of fluid types, wherein the nozzles of each subset are substantially aligned in the primary scanning direction; and a control unit, configured to:

control the print unit; and select the subset of nozzles; and control the ejection inspection unit to inspect the subset each time a specific amount of printing is completed.

2. The fluid droplet ejection device of claim 1, wherein the nozzles of each nozzle line are disposed at a substantially uniform interval in the secondary scanning direction, wherein the nozzle lines are disposed in nozzle line groups of N lines offset 1/N of the interval in the secondary scanning direction, where N is a positive integer, and wherein the substantial alignment of the nozzles of each subset comprises an offset of less than one interval in the secondary scanning direction between all the nozzles in each subset.

3. The fluid droplet ejection device of claim 1, further comprising a cleaning unit configured to clean the print unit when more than a first specific number of the nozzles fail inspection during a second specific number of ejection inspections.

4. The fluid droplet ejection device of claim 3, wherein the print unit is configured to reprint immediately preceding content after cleaning is performed.

5. The fluid droplet ejection device of claim 1, wherein the fluid droplets are electrically charged, and wherein the ejection inspection unit comprises:

an ejection drive unit configured to cause the print unit to eject the fluid droplets from the nozzles, an ejection target configured for the fluid droplets that were ejected to land thereon, and a detection unit configured to detect a change in current produced in the ejection target when the fluid droplets land on the ejection target, and to determine ejection or lack of ejection from the nozzles based on the change in the current.

6. The fluid droplet ejection device of claim 1, wherein each of the fluid types is a color of ink.

* * * * *